US005263619A

United States Patent [19]

Shoemaker

[11] Patent Number: 5,263,619

[45] Date of Patent: Nov. 23, 1993

[54] BATON HOLDER

[76] Inventor: Randy R. Shoemaker, 4819 St. Andres, LaVerne, Calif. 91750

[21] Appl. No.: 744,090

[22] Filed: Aug. 9, 1991

[51] Int. Cl.[5] ..... A45F 5/00

[52] U.S. Cl. ..... 224/240; 224/236; 224/249; 224/251; 224/253; 224/914

[58] Field of Search ..... 224/914, 253, 224, 241, 224/245, 249, 251, 252, 228, 235, 236, 240, 241; 206/349; 383/86; 150/161

[56] References Cited

U.S. PATENT DOCUMENTS

| | | | |
|---|---|---|---|
| 4,006,851 | 2/1977 | Kippen | 224/914 |
| 4,662,552 | 5/1987 | Uyehara | 224/914 |
| 4,955,518 | 9/1990 | Parsons et al. | 224/914 |
| 5,002,214 | 3/1991 | Caranci | 224/252 |

*Primary Examiner*—Linda J. Sholl
*Attorney, Agent, or Firm*—Boniard I. Brown

[57] ABSTRACT

A holder for a telescoping police baton has a generally tubular body for receiving the baton endwise, either end first and with the baton contracted or extended, an annular shoulder within the lower end of the body which is engagable with the lower end of the outer baton section to support the baton vertically and through which the inner baton section may extend if the baton is placed in the holder in its extended configuration, and a cup-shaped cover which receives the upper end of the baton when housed in the holder in a manner which prevents an unauthorized person, such as an arrestee, from forcing the cover sideways and pulling the baton from the holder.

6 Claims, 1 Drawing Sheet

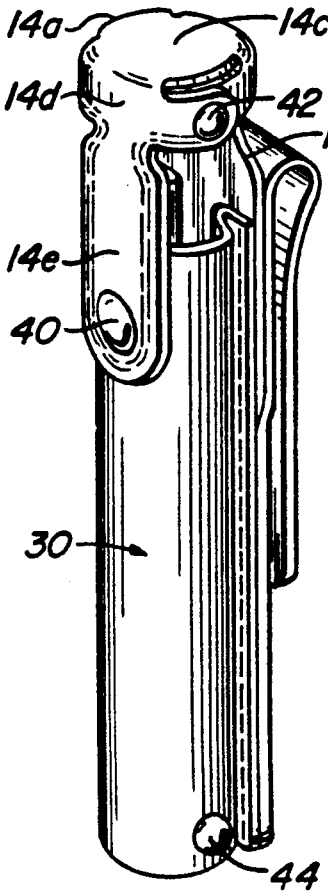
FIG-.1
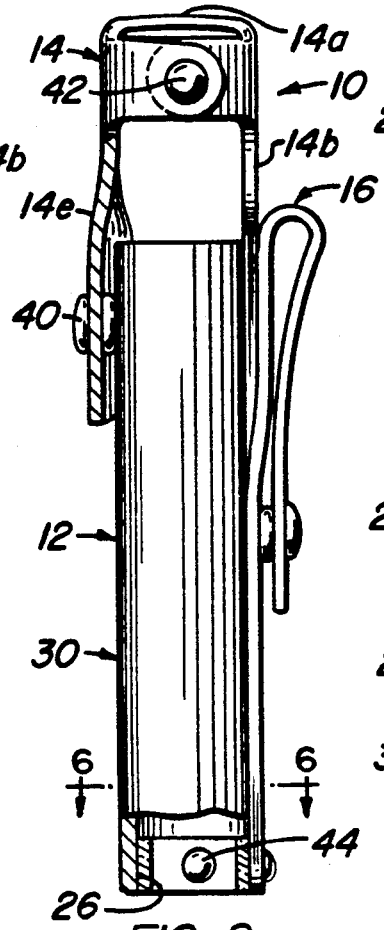
FIG-.2
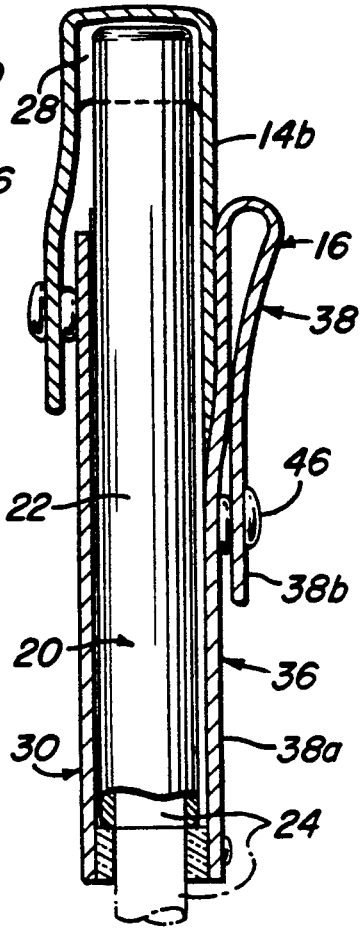
FIG-.3
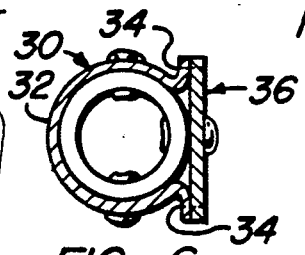
FIG-.6
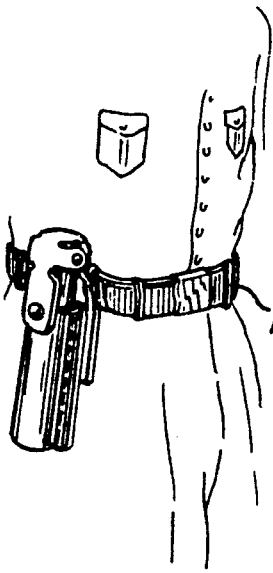
FIG-.4
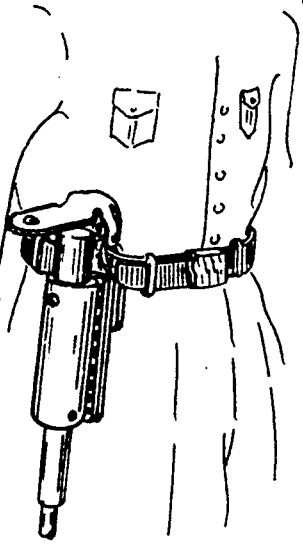
FIG-.5
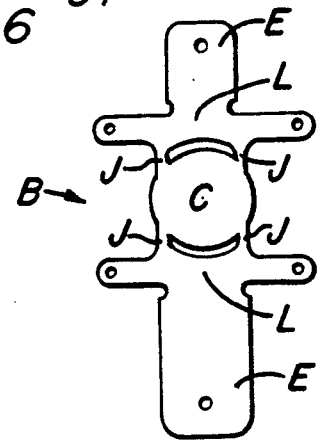
FIG-.7

BATON HOLDER

BACKGROUND OF THE INVENTION

1. Field of the Invention

This invention relates generally to police equipment and more particularly to a novel holder for a telescoping police baton.

2. Prior Art

It is common practice for police officers to carry batons which can be used as weapons, as crowd control aids, and for other purposes. When not in use, the baton is generally placed in a baton holder attached to the officer's belt in a manner which permits rapid removal of the baton from the holder when necessary. One type of police baton in current use is a telescoping baton having inner and outer telescoping sections. The inner section is retractable into the outer section to provide the baton with a short overall length for convenience of carrying when not in use. The inner baton section can be rapidly extended to provide the baton with a relatively long overall length for use by grasping the outer section and rotating the baton with a rapid twist or snap of the wrist.

A variety of baton holders have been devised. One type of baton holder in current use is simply a ring attached by a strap or the like to the police officer's belt. The baton is inserted endwise through the ring to a position in which the ring supports the baton with most of the length of the baton hanging below the ring. This type of holder is not suitable for telescoping batons. The existing holders for telescoping police batons comprise a holster-like body constructed of leather or other suitable material and arranged to receive a baton in either its extended or contracted configuration, and a cover strap for retaining the baton in the holder body. The holder body has an open upper end through which the baton is insertable endwise into the body and a lower end closed by a bottom-forming portion which supports the baton vertically in the body. This bottom-forming portion is made of the same material as the holder body and contains a slit-like opening through which the inner telescoping section of the baton may extend below the body in the event that the baton is inserted into the holder in its extended configuration.

This existing telescoping baton holder has certain deficiencies which the present invention eliminates. One of these deficiencies resides in the fact that over a period of time, the slit-like opening in the bottom-forming portion of the holder body tends to enlarge due to wear and stretching of the material about the opening. Quite frequently, this opening becomes sufficiently enlarged to permit the baton to drop through the bottom of the holder.

Another deficiency of the existing telescoping baton holders concerns their cover strap. This cover strap is permanently fixed at one end to the holder body at one side of its open upper end. The other end of the strap is releasably attached to the opposite side of the body by releasable securing means, such as a snap fastener. When closed, the cover strap extends over the open upper end of the holder body in such a way that the strap overlies the upper end of a baton positioned in the holder. The purpose of this cover strap is to prevent accidental loss of the baton from the holder during strenuous activity of the police officer, and to prevent an unauthorized person, such as a person being arrested, from removing the baton from the holder. The cover strap of the existing telescoping baton holders, however, is relatively flat and capable of being quite easily force sideways from the upper end of the baton sufficiently to enable the baton to be pulled upwardly from the holder.

SUMMARY OF THE INVENTION

This invention provides an improved telescoping baton holder which avoids the above noted and other deficiencies of the existing baton holders of this kind. The improved baton holder comprises a generally tubular body having open, normally upper and lower ends, a cover member mounted on the upper end of the body for movement between open and closed positions, and means for attaching the holder to a police officer's belt. When the cover member is open, a telescoping baton may be freely inserted endwise into and removed endwise from the body through its open upper end. When closed, the cover member overlies the open upper end of the holder body to prevent upward movement of a baton from the body.

One improved feature of the baton holder resides in the provision of a relatively hard wear and stretch resistant shoulder within the lower end of the holder body for supporting the baton vertically within the body. The holder will support the baton in either its contracted configuration, in which case the baton will be completely contained within the body, or in its extended configuration, in which case the extended inner telescoping section of the baton extends through and below the lower open end of the body. In the preferred embodiment of the invention, this shoulder is an annular shoulder in the form of a hard ring secured to the holder body. This feature of the invention precludes the possibility of the baton dropping through the bottom of the holder, as can occur in the existing telescoping baton holders.

Another improved feature of the present baton holder resides in the fact that its cover member has a recess which receives the upper end of a baton positioned in the holder. Engagement of the upper baton end in this recess prevents the cover member from being forced sideways from the upper end of the baton to a position in which the baton could be removed upwardly from the holder. The cover member of the preferred baton holder of the invention comprises a strap-like member having a generally cup-shaped central portion and opposite tongue-like ends. One of these ends of the cover member is permanently secured to the holder body at one side of its open upper end to form a flexible hinge which supports the cover member on the body for movement between its open and closed positions. The other end of the cover member is releasably attachable to the opposite side of the holder body by releasable securing means, such as a snap fastener, to releasably secure the cover member in its closed position. In this closed position, the cup-shaped central portion of the cover member overlies and opens downwardly toward the open upper end of the holder body to receive the upper end of a baton positioned in the holder. An additional feature of the invention resides in a unique way in which the preferred cover member is made from a shaped blank of material which may be the same material as that of the holder body.

The improved baton holder of the invention has two additional important advantages. These advantages reside in the ability of the holder to receive a baton either end first, and the ability of the holder to receive a baton in either its extended configuration or its contracted configuration. The parts of the baton holder may be made from leather or any other suitable material.

BRIEF DESCRIPTION OF THE DRAWINGS

FIG. 1 is a perspective view of a presently preferred baton holder according to the invention;

FIG. 2 is a side elevation of the baton holder with portions of the holder broken away for clarity;

FIG. 3 is a longitudinal section through the baton holder with a telescoping police baton positioned in the holder and showing in broken lines the inner telescoping section of the baton extended through the open lower end of the holder;

FIG. 4 illustrates the baton holder worn on the belt of a police officer with the cover of the holder closed to retain a baton in the holder;

FIG. 5 is a view similar to FIG. 4 showing the cover of the holder open to permit removal of the baton from and insertion of baton into the holder;

FIG. 6 is a section taken on line 6—6 in FIG. 2; and

FIG. 7 is a plan view of a shaped blank from which the cover member of the baton holder is made.

DESCRIPTION OF THE PREFERRED EMBODIMENT

Referring now to these drawings, the baton holder 10 of the invention comprises a generally tubular body 12 having open normally upper and lower ends, a cover member 14, and means 16 for attaching the holder to a police officer's belt 18. The cover member 14 is attached to the upper end of the holder body 12 for movement of the cover between its closed position shown in FIGS. 1–4 and its open position of figure 5. When the cover member 14 is closed, a central portion **14*a* of the member overlies the open upper end of the holder body 12**.

The baton holder 10 is adapted to receive a telescoping police baton 20. This baton is conventional and hence need not be described in elaborate detail. Suffice it to say that the baton 20 comprises outer and inner telescoping sections 22, 24. The inner baton section 24 may be retracted into the outer baton section 22 to place the baton in a contracted configuration, shown in solid lines in FIG. 3, in which the baton has a relatively short overall length. The inner baton section 24 may be extended from the outer baton section 22, as illustrated in broken lines in FIG. 3, to place the baton in an extended configuration in which it has a relatively long overall length and is normally used. The baton includes means (not shown) for releasably retaining the baton sections in these retracted and extended positions in such a way that the baton may be quickly extended by grasping the outer section and rapidly snapping the baton with a twist of the wrist. The baton is contracted by pushing the two sections toward one another.

The baton 20 is placed in the baton holder 10 by opening its cover member 14 and inserting the baton endwise into the holder body 12 through its open upper end. As mentioned earlier and will be evident from the ensuing description, the baton may be inserted into the holder either end first and with the baton in either its contracted configuration or its extended configuration. One improved feature of the baton holder resides in a shoulder 26 within the lower end of the holder body 12 for supporting the baton 20 vertically within the body in a manner which eliminates the possibility of the baton dropping through the bottom of the holder body. Another improved feature of the baton holder resides in a recess or cavity 28 in the normally underside of the central portion **14*a* of the holder cover member 14. This cavity receives the upper end of the baton 20 when it is positioned in the holder 12** and prevents the cover member from being forced sideways from the upper baton end to enable the baton to be pulled upwardly from the holder.

Referring now in more detail to the drawings, the body 12 of the illustrated baton holder 10 comprises a front or outer side wall 30 including a cylindrically curved portion 32 forming a rear or inner opening bounded along two opposite sides parallel the axis of the curved portion by outwardly directed coplanar flanges 34. The holder body has a rear or inner side wall 36 which closes the rear opening formed by the front side wall 30 and comprises, in part, one end **38*a* of cover member 14. The end 14*b* of the cover member seats against the normally upper end portions of the front wall flanges 34. The strap end 38*a* seats against the normally lower end portions of the flanges 34 and overlaps a substantial portion of the end 14*b*, as shown best in FIGS. 2 and 3. The front wall flanges 34 and the ends 14*b*, 38*a* of the cover member 14 and strap 38 are firmly and permanently joined in any suitable way, such as by stitching, rivets, and/or adhesive. It is evident, therefore, that the holder body 12 is generally tubular in shape and comprises the front wall 30 and the rear wall 36 which is formed, in part, by the end 14*b* of the cover member 14 and in part by the end 38*a* of strap 38**.

The central portion **14*a* of the cover member 14 is a generally cup-shaped portion having a normally top wall 14*c* and a generally annular side wall 14*d* about the edge of top wall which together form the baton receiving cavity 28. Extending from the normally bottom edge of the cover side wall 14*d* at diametrically opposite sides of this side wall are the tongue-like end 14*b* and a second tongue-like flap 14*e*. The end 14*b*, which as noted above is secured to the rear side of the holder body front side wall 30, forms a flexible hinge that supports the cover member 14 on the holder body 12 for movement its said open and closed positions. As shown in FIGS. 2 and 3, when the cover member 14 is closed, its central cup-shaped portion 14*a* overlies, and its cavity 28 opens downwardly toward, the open upper end of holder body 12. The cover flap 14*e* then overlaps the upper front edge of the holder body 12 diametrically opposite the attachment of the rear cover hinge end 14*b* to the holder body. The holder body 12 and cover flap 14*e* have quick release securing means 40**, such as a snap fastener, for releasably securing the cover member in closed position.

The illustrated cover member 14 is formed from the flexible blank B illustrated in FIG. 7. This blank has a generally circular central portion C, a pair of laterally extending portions L at diametrically opposite sides of and joined at spaced junctures J between their ends to the central portion C, and longitudinally aligned end portions E joined at one end to the centers of and extending laterally from the lateral portions L. The ends of these lateral portions have tongue-like shapes. The cover member 14 is formed from the blank B by folding the lateral portions L of the blank generally normal to and beyond the same side (the normally lower side) of the central blank portion C, then folding these lateral portions circumferentially about the central blank portion C to place the adjacent ends of the lateral portions in overlapping relation, and finally joining these overlapping ends by fasteners 42 or the like.

The illustrated shoulder 26 within the lower end of the holder body 12 comprises a ring of metal, plastic, or other relatively hard, wear and stretch resistant material. The ring is coaxially disposed within the holder and is rigidly secured to the holder by rivets 44 or the like.

The rear strap 38 on the holder body 12 forms the means 16 for attaching the baton holder 10 to the police officer's belt 18. To this end, the free end **38*b* of the strap is secured to the fixed strap end 38*a* by releasably engagable fastening means 46, such as a snap fastener, to form a loop for receiving the officer's belt. The baton holder is worn at the side as shown in FIGS. 4 and 5**.

A telescoping baton 20 is placed in the baton holder 10 by opening the cover member 14 and inserting the baton endwise, either end first, into the holder body 12 through its open upper end and to a housed position within the body wherein the lower end of the outer baton section 22 rests on the lower shoulder ring 26. The cover member 14 is then closed. The holder is sized so that when baton is thus positioned in the holder, the upper end of the baton projects above the upper end of the holder body and into the recess or cavity 28 in the cover member. This engagement of the upper baton end in the cover cavity prevents a person, such as an arrestee, from forcing the cover member sideways to a position which would permit the person to remove the baton from the holder.

In some situations, an officer may have insufficient time to contract the baton before inserting it into the holder. For this reason, the central opening through the lower shoulder ring 26 is made somewhat larger in diameter than the inner baton section 24 to permit an extended baton to be inserted into the holder, extended inner section first. The extended baton is inserted into the holder to a position wherein the outer baton section rests on the shoulder ring and the inner baton section extends through the ring and below the holder.

Thus there has been shown and described a novel baton holder which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

I claim:

1. A holder for a telescoping police baton having telescoping sections including an outer section and an inner section which is extendable beyond one end of said outer section, said holder comprising:

a generally tubular holder body having an open normally upper end, an open normally lower end, a substantially uniform diameter between said ends, and a rigid shoulder ring coaxially fixed within said holder body at said lower open end thereof, a cover member mounted on said upper end of said holder body for movement between a closed position wherein a certain portion of said cover member overlies and closes said open body end with one side of said cover portion facing said said open end and an open position wherein said cover member uncovers said open body end for endwise insertion and removal of the baton into and from said holder body, releasable fastening means for releasably securing said cover member in said closed position, and wherein said holder body is adapted to receive the baton endwise in a housed position within said body wherein said one end of said outer baton section seats on said shoulder ring, the other end of said outer baton section extends above said open end of the body to be gripped for removing the baton upwardly from the holder, and said inner baton section is disposed in one of the following positions relative to said outer baton section: (a) a retracted position within said outer baton section, (b) an extended position within said outer baton section wherein said inner section extends from said one end of said outer baton section and through said shoulder ring, and said cover portion has a generally inverted cup shape forming a cavity at said one side of said cover portion for receiving said other end of the outer baton section when the baton occupies said housed position in said holder body, whereby said baton prevents lateral displacement of said cover member relative to the the holder body sufficiently to remove the baton from the holder without releasing said fastening means.

2. A baton holder according to claim 1 wherein:

said holder body comprises a planar rear wall having longitudinal edges, and a front wall including a cylindrically curved portion having a concave side facing said rear wall and outwardly directed flanges seating against and secured to said rear wall along said longitudinal edges thereof.

3. A holder for a police baton comprising:

a generally tubular holder body having an open normally upper end for receiving a baton endwise in a housed position within said body wherein one end of the baton is exposed at said open end of the body to be gripped for removing the baton from the holder, a cover member mounted on said upper end of said holder body for movement between a closed position wherein a certain portion of said cover member overlies and closes said open body end with one side of said cover portion facing said said open end and an open position wherein said cover member uncovers said open body end for endwise insertion and removal of the baton into and from said holder body, means for releasably securing said cover member in said closed position, and wherein said cover portion is a generally cup-shaped portion having a normally top wall, a generally annular side wall about the edge of said top wall, and a cavity at said one side of said cover portion for receiving said one end of the baton when in said housed position in said holder body, and said cover member includes a flexible tongue portion at one side of said cup-shaped portion secured to said holder body at one side of said open body end to form a flexible hinge which supports said cover member on said body for movement between said open and closed positions, and a flap at the other side of said cup-shaped portion which overlaps the opposite side of said open body end when said cover member is closed, said means for releasably securing said cover member in said closed position comprises quick release fastening means on said holder body and said cover flap, said holder includes means for attaching said holder body to a belt, said cover member is formed from a flat flexible blank including a generally circular central portion, a pair of lateral portions at diametrically opposite sides of and joined at spaced junctures between their ends to said circular portion, whereby said lateral portions have free ends, and longitudinally aligned tongue portions joined at one end to the centers of said lateral portions and extending laterally from said lateral portions, said lateral portions are folded generally normal to and beyond the same side of said circular blank portion and circumferentially about said circular blank portion to overlap the adjacent free ends of said lateral portions, and said cover member includes means joining said overlapping free ends of said lateral portions, whereby said circular portion and said lateral portions form said top wall and annular side wall, respectively, of said cup-shaped portion of said cover member, and said tongue portions form said flexible hinge and flap, respectively, of said cover member.

4. A holder for a police baton comprising:

a generally tubular holder body having an open normally upper end for receiving a baton endwise in a housed position within said body wherein one end of the baton is exposed at said open end of the body to be gripped for removing the baton from the holder, a cover member mounted on said upper end of said holder body for movement between a closed position wherein a certain portion of said cover member overlies and closes said open body end with one side of said cover portion facing said open end and an open position wherein said cover member uncovers said open body end for endwise insertion and removal of the baton into and from said holder body, means for releasably securing said cover member in said closed position, and wherein said holder is adapted to receive a telescoping baton having telescoping sections including an outer section and an inner section, said holder body has an open normally lower end, and an internal shoulder about said lower open end, said holder body is adapted to receive said telescoping baton in said housed position within said holder body wherein said outer baton section seats on said shoulder and said inner baton section is disposed in one of the following positions: (a) retracted within said outer baton section, (b) extended from said outer baton section through said open lower end of said holder body, said cover portion is a generally cup-shaped portion having a normally top wall, a generally annular side wall about the edge of said top wall, and a cavity at said one side thereof for receiving said one end of the baton when in said housed position in said holder body, and said cover member includes a flexible tongue portion at one side of said cup-shaped portion secured to said holder body at one side of said open body end to form a flexible hinge which supports said cover member on said body for movement between said open and closed positions, and a flap at the other side of said cup-shaped portion which overlaps the opposite side of said open body end when said cover member is closed, said means for releasably securing said cover member in said closed position comprises quick release fastening means on said holder body and said cover flap, said holder includes means for attaching said holder body to a belt, said cover member is formed from a flat flexible blank including a generally circular central portion, a pair of lateral portions at diametrically opposite sides of and joined at spaced junctures between their ends to said circular portion, whereby said lateral portions have free ends, and longitudinally aligned tongue portions joined at one end to the centers of said lateral portions and extending laterally from said lateral portions, said lateral portions are folded generally normal to and beyond the same side of said circular blank portion and circumferentially about said circular blank portion to overlap the adjacent free ends of said lateral portions, and said cover member includes means joining said overlapping free ends of said lateral portions, whereby said circular portion and said lateral portions form said top wall and annular side wall, respectively, of said cup-shaped portion of said cover member, and said tongue portions form said flexible hinge and flap, respectively, of said cover member.

5. In combination:

a telescoping police baton having telescoping sections including an outer section and an inner section which is extendable beyond one end of said outer section, said holder, a baton holder comprising a generally tubular holder body having an open normally upper end, an open normally lower end, a substantially uniform inner diameter between said upper and lower ends, a rigid shoulder ring fixed within the lower end of said holder body, a cover member mounted on said upper end of said body for movement between a closed position wherein a certain portion of said cover member overlies said open body end with one side of said cover portion facing said said open body end and an open position wherein said cover member uncovers said open body end, releasable fastening means releasably securing said cover member in said closed position, and wherein said cover portion has has a generally inverted cup shape forming a cavity at said one side of said cover portion, and said holder receives said baton endwise in a housed position in said holder body wherein said one end of said outer baton section seats on said shoulder ring, the other end of the outer baton section projects above said open upper end of said holder body into said cavity in said cover member, whereby said baton prevents lateral displacement of said cover member relative to said holder body sufficiently to remove the baton from the holder without releasing said fastening means, and said inner baton section is disposed in one of the following positions relative to said outer baton section: (a) a retracted position within said outer baton section, (b) an extended position within said outer baton section wherein said inner section extends from said outer baton section through said shoulder ring.

6. A baton holder according to claim 3 wherein:

said holder body comprises a planar rear wall having longitudinal edges, and a front wall including a cylindrically curved portion having a concave side facing said rear wall and outwardly directed flanges seating against and secured to said rear wall along said longitudinal edges thereof.

* * * * *